US005725889A

United States Patent [19]

Buck

[11] Patent Number: 5,725,889

[45] Date of Patent: Mar. 10, 1998

[54] PHENOLIC STAIN-RESISTS

[75] Inventor: Robert Craig Buck, West Grove, Pa.

[73] Assignee: E. I. du Pont de Nemours and Company, Wilmington, Del.

[21] Appl. No.: 718,125

[22] Filed: Sep. 18, 1996

[51] Int. Cl.[6] ..... D02G 3/00; B32B 27/42; C07C 315/00; B05D 3/02

[52] U.S. Cl. ..... 428/375; 428/96; 428/447.4; 428/524; 252/8.61; 252/8.62; 427/393.4; 562/429

[58] Field of Search ..... 252/8.61, 8.62; 428/375, 96, 395, 447.4, 524; 427/393.4; 562/429

[56] References Cited

U.S. PATENT DOCUMENTS

| | | | |
|---|---|---|---|
| 4,453,002 | 6/1984 | Maurer et al. | 562/429 |
| 5,447,755 | 9/1995 | Pechhold et al. | 427/393.4 |
| 5,460,891 | 10/1995 | Buck et al. | 428/477.4 |

*Primary Examiner*—Newton Edwards

[57] ABSTRACT

Polyamide fibrous substrates which resist staining by acid dyes, and processes for preparing the same which comprise applying, at pH 2 to 10, a base-catalyzed condensation product formed by the condensation reaction of a mixture of bis(hydroxyphenyl)sulfone and at least one other phenolic compound with formaldehyde to give a product known as a resole.

12 Claims, No Drawings

PHENOLIC STAIN-RESISTS

FIELD OF THE INVENTION

The present invention relates to polyamide and wool substrates treated with a phenolic copolymer which imparts resistance to staining by acid dyes. It further relates also to a process for treating said substrates and the phenolic copolymer used to treat said substrates.

BACKGROUND OF THE INVENTION

Polyamide substrates, such as nylon carpeting and upholstery fabric and similar wool substrates, are subject to staining by a variety of agents. Acid dyes are especially troublesome staining agents, e.g. FD&C Red Dye No. 40, commonly found in soft drink preparations. Prior proposals for inhibiting staining of polyamide substrates by acid dyes include application of sulfonated phenol-formaldehyde condensates, alone, or in combination with hydrolyzed maleic anhydride polymers or polymers of methacrylic acid, acrylic acid, or itaconic acid, or combinations of the same. It has been reported to be essential that the acid dye stain-resist agent contain acid groups in order to impart water-solubility to said condensates and polymers; i.e. sulfonic acid groups in the sulfonated phenol/formaldehyde condensates and carboxylic acid groups in the polymers of maleic anhydride, methacrylic acid and the like. It has also been reported that as the ratio of units containing one $—SO_3X$ radical to units containing no $—SO_3X$ radicals increases, the product becomes a better stain blocker. In addition, it has been reported that in order to be effective, stain-resists must be applied below pH of 4.5, preferably below 3.0; however, operating at such low pH has the potential for causing corrosion of equipment as well as safety and environmental problems.

A formaldehyde/naphthol condensate having no carboxylic or sulfonic acid groups and having restraining effects to anionic dyes has been reported. However, testing of the resulting compound, 2,2'-dihydroxy-1,1'-dinaphthylmethane, by the procedures described in the present specification showed it to be unacceptable as a stain-resist agent for polyamide fibers.

U.S. Pat. No. 5,447,755 and 5,460,891 disclosed that base-catalyzed condensation products of bis(hydroxyphenyl)sulfone and formaldehyde impart to polyamide substrates resistance to staining by acid dyes and discoloration upon exposure to UV light.

It is desirable to have an acid dye stain resist which can be applied at a pH above 4.5 and which contains no sulfonic acid groups. The present invention provides such compositions.

BRIEF SUMMARY OF THE INVENTION

The present invention comprises a stain-resist composition comprising a resole condensate prepared by reacting a phenolic mixture comprising bis(hydroxyphenyl)sulfone (BHPS) and at least one other phenolic compound with formaldehyde in the presence of a base comprising an inorganic compound having a pKa of 8.5 or higher, at a formaldehyde:phenolic mixture molar ratio in the range between 0.6:1.0 and 4.0:1.0, a base:phenolic mixture molar ratio in the range between 0.1:1.0 and 3.5:1.0, and a molar ratio of said at least one other phenolic compound:BHPS in the range between 0.05:1.0 and 1.0:1.0.

The present invention further comprises a nylon or wool substrate having deposited thereon an amount effective to impart resistance to staining by acid dyes of a stain resist composition comprising a resole condensate prepared as described above.

The present invention further comprises a process for imparting acid dye stain resistance to a nylon or wool substrate which comprises applying to said substrate an amount effective to impart resistance to staining by acid dyes of a stain-resist composition comprising a resole condensate prepared as described above.

DETAILED DESCRIPTION OF THE INVENTION

The present invention provides novel non-sulfonated, water-dispersible or water-soluble compositions of matter, called resoles, which are prepared by the base-catalyzed condensation reactions of formaldehyde with mixtures of bis(hydroxy-phenyl sulfone (BHPS) and at least one other phenolic compound. The phrase "at least one other phenolic compound" is sometimes referred to hereinafter as the "phenolic compound", and the phrase "BHPS and at least one other phenolic compound" is sometimes referred to hereinafter as the "BHPS/phenolic mixture". The present invention also provides polyamide or wool substrates having acid dye stain-resistance and the process for preparing the same.

The resole compositions of this invention are less sensitive to the pH at which they are applied to the polyamide substrate than previously known stain-resists which were sulfonated or carboxylated or both. The compositions of this invention can be applied at higher pH values than the aforesaid prior art sulfonated or carboxylated stain-resists. Moreover, in contrast to the need for sulfonic acid groups in prior art stain-resists, the base-catalyzed resole condensation products with which the substrates of this invention are treated contain no such sulfonic acid groups and yet are effective stain-resist agents when applied to polyamide or wool substrates. Thus, the resole stain-resists have been found to provide commercially adequate acid dye stain-resistance when applied at pH levels between 2 and 10 to polyamide substrates. The ability to treat substrates at pH above 4.5 affords these resoles significant advantages due to reduced equipment corrosion, safer handling, and improved environmental suitability. On the other hand, the UV-discoloration resistance of polyamide substrates treated with the non-sulfonated resole condensates of this invention varies more with change in pH than does the acid dye stain-resistance. A preferred embodiment of this invention provides a process for application of non-sulfonated resole condensates to polyamide and wool substrates which renders said substrates resistant to staining by acid dyes. In that preferred embodiment, the resole stain-resists, dissolved or dispersed in water, are applied to the polyamide substrates at a pH in the range between 2 and 4 or between 6.0 and 8.0, preferably at a pH in the range between 6.0. and 7.0.

The BHPS used in this invention is 4,4'-sulfonyldiphenol or its isomers, such as 2,4'-sulfonyldiphenol, 2,2'-sulfonyldiphenol, etc. or mixtures of the same. Examples of phenolic compounds which, according to the invention, are condensed with BHPS include p-phenylphenol, 4-hydroxyacetophenone, 4,4'-isopropylidenediphenol (hereinafter referred to as bisphenol A or BPA), 4,4'-(hexafluoroisopropylidene)diphenol (hereinafter referred to as bisphenol AF or BPAF), 3-hydroxybenzoic acid, or 4-hydroxybenzoic acid. The base useful as the catalyst in the condensation reaction is any aqueous solution of an inorganic compound having a pKa of 8.5 or greater which, when dissolved in water, renders it basic and which does not add to formaldehyde. For example, ammonia should not be used. Examples of suitable bases include, but are not limited to, alkali metal hydroxides, alkali metal carbonates, alkali metal bicarbonates, alkali metal borates, alkaline earth metal hydroxides, alkaline earth metal carbonates, alkaline earth metal borates or mixtures thereof. The preferred base is sodium or potassium hydroxide, most preferably sodium hydroxide.

In preparing the resoles of this invention by the condensation of the BHPS/phenolic mixture with formaldehyde, generally one uses a basic aqueous medium, elevated temperature, autogenous pressure, and for safety, an inert atmosphere. The molar ratio of formaldehyde to the BHPS/phenolic mixture is in the range between 0.6:1.0 and 4.0:1.0, preferably in the range between 0.6:1.0 and 1.1:1.0, and most preferably in the range between 0.7:1.0 and 0.9:1.0. The molar ratio of said phenolic to BHPS is in the range between 0.05:1.0 and 1.0:1.0, preferably in the range between 0.1:1.0 and 05:1.0. The molar ratio of base to the BHPS/phenolic mixture is in the range between 0.1:1.0 and 3.5:1.0, preferably in the range between 0.2:1.0 and 1.0:1.0. When the mol ratio of formaldehyde to the BHPS/phenolic mixture is in the range between 0.6:1.0 and 1.1:1.0, all of the base is added at the start of the reaction at a preferred molar ratio of base to BHPS/phenolic mixture in the range between 0.2:1.0 and 0.8:1.0. Too high or too low a molar ratio of base to said mixture yields a resole product which is incapable of imparting satisfactory acid dye stain-resistance to polyamide substrates. Reaction conditions may vary; i.e. in order to complete the condensation reaction, suitable temperatures are in the range between 100° C. and 200° C., and the reaction is run over a time period of one-quarter hour to twenty four hours.

At formaldehyde to BHPS/phenolic mixture molar ratios in the range between 1.1:1.0 and 4.0:1.0, it is preferred that the base is added in two stages so as to prevent gelation. It is also preferred that in the range between 0.2 and 0.8 mole of base per mole of BHPS/phenolic mixture, the base is added at the start of the reaction and that the reaction be run at 80° C.–100° C., preferably 100° C., for 4–12 hours, most preferably at 100° C. for 6 hours. After completion of the 4–12 hour reaction time period, additional base is added. The amount of additional base is in the range between 0.4 and 3.3 moles of base per mole of BHPS/phenolic mixture, preferably 1.0 mole of base per mole of said mixture. The reaction is then heated to a temperature in the range between 100° C. and 200° C., preferably in the range between 125° C. and 150° C., over a time period of one-quarter hour to 24 hours, preferably one-quarter to six hours. Reaction times at temperatures greater than 100° C. are monitored to prevent product gellation. If the molar ratio of formaldehyde to BHPS/phenolic mixture is too high without sufficient base present, gellation will occur, and if the molar ratio of formaldehyde to BHPS/phenolic mixture is too low, a significant amount of unreacted BHPS will remain in the product and the reaction can yield a resole product which is incapable of imparting satisfactory acid dye stain-resistance to polyamide substrates. At the end of the condensation reaction, whether one or two stages, the product is cooled to room temperature, and, as necessary, dissolved in sufficient aqueous base to give a translucent brownish solution. Bases suitable for dissolving the resole resins of this invention are the same as those used in the condensation reaction.

Polyamide or wool substrates, for example fiber, yarn, textiles, or carpet, are rendered stain-resistant to acid dyes when contacted with aqueous solutions or dispersions of the resole condensates of this invention at various pH values with or without electrolytes, and optionally surfactants, followed by steaming or heating. Preferred polyamides include nylon, for example nylon 6, nylon 6,6 and producer colored nylon (wherein color is added to the fiber during spinning). The resole condensates of this invention are effectively applied by a wide variety of methods known to those skilled in the art, such as: knife over roll overflow applicator (e.g., Kusters Roll), padding, spraying (e.g., Otting Spray Applicator), foaming in conjunction with foaming agents (e.g., Kusters Foam Applicator, Kusters Fluicon), batch exhaust in beck dyeing equipment, or continuous exhaust during a continuous dyeing operation (e.g., Kusters Flex-Nip, or Kusters Fluidyer).

The resole condensates of this invention are applied by the aforesaid methods to dyed or undyed polyamide or wool textile substrates, or to polyamide or wool fiber via a finish during fiber spinning, twisting, or heat setting, or to a carpet already installed in a residential or commercial location as all or part of an after-market application. In addition, the resole stain-resists of this invention are applied to such substrates in the absence or presence of fluorinated oil-, water-, and/or soil repellent materials. In the alternative, such a fluorinated material is applied to the textile substrate before or after application of the resole stain-resists of this invention thereto. The quantities of the resole stain-resists of this invention which are applied to the polyamide fiber or textile substrate, are amounts effective in imparting stain-resistance. For practical reasons, the resoles of this invention are applied to polyamide fiber or fabric at concentrations which are as low as will be suitable for commercial applications. Such concentrations can be readily determined by those skilled in the art by using test methods which are well-known in the art, such as those set forth hereinbelow. For example, the stain-resist is applied at a concentration in the range between 0.1 and 5.0% of the resole based on the weight of fiber or fabric (owf), preferably between 0.3 and 2.0% owf. The bath concentration is adjusted to the desired weight % with water.

In contrast to many prior art stain-resists which require application at a pH below 4 (preferably 3 or lower) in order to impart to polyamide substrates commercially adequate resistance to staining by acid dyes, the resole condensates of the present invention are applied by any of the techniques described above at a pH between 2 and 10. A surfactant is required for application below pH 6, with more surfactant being necessary at lower pH than at a pH approaching 6. The amount of surfactant is that necessary to provide a homogeneous stable aqueous dispersion of the stain-resist or blend of stain-resist. Thus the required amount can be determined by one skilled in the art by observing the aqueous system in which it is used. For example, one can use an alkylated disulfonated diphenyl oxide (such as that sold by Dow Chemical Co. under the trademark Dowfax, by Pilot Chemical Co. under the trademark Calfax and by American Cyanamid Co. under the trademark Aerosol DPOS); alpha-olefin sulfonates (such as that sold by Pilot Chemical Co. under the trademark Calsoft); or sodium lauryl sulfates (such as that sold by Witco Chemical Co. under the trademark Duponol WAQE). The surfactant is typically used in quantities in the range between 0.1% and 10% owf, preferably between 1% and 5% owf.

Acid dye stain-resistance is enhanced by the use of electrolytes, usually at concentrations in the range between 2.5 and 500% based on the weight of resole condensate, preferably between 50 and 250%. The electrolyte is any water-soluble compound which contains a monovalent or polyvalent cation or anion. Monovalent cations such as ammonium, lithium, sodium, potassium are preferred below pH 5.5. Suitable polyvalent cations include barium, calcium, magnesium, strontium, aluminum, and zinc. Monovalent or polyvalent anions are used in this invention, such as fluoride, chloride, bromide, iodide, hypochloride, chlorate, bromate, iodate, carbonate, bicarbonate, sulfate, sulfite, bisulfite, thiosulfite, thiosulfate, nitrate, nitrite, phosphate, hypophosphate, monohydrogen phosphate, dihydrogen phosphate, pyrophosphate, tripolyphosphate, polyphosphate, borate, silicate, metasilicate, cyanate, thiocyanate, formate, acetate, propionate, oxalate, tartrate, citrate, glycolate, thioglycolate, tetraborate, and dithionate. Exhaust or fixation of the resole condensate is accomplished at bath or solution temperatures ranging from 20° C. to 100° C. over a few seconds to one hour, preferably 50° C. to 80° C.

The preferred acid for pH adjustment of the treatment bath to pH levels of 6 and lower is sulfamic acid, although other strongly acidic materials having low pK values are also suitable for the purposes of this invention. As mentioned above, a surfactant must be present when applying the non-sulfonated resoles of this invention to polyamide substrates at acidic pH, although a surfactant may also be present during the application at non-acidic pH without significant negative effect. For adjustment of the treatment bath to pH levels in the range of pH 6 to pH 8, the preferred acid is citric acid, although again other acidic materials are also suitable. The preferred base for pH adjustment of the treatment bath to pH levels of 8 and higher is sodium carbonate, although other strongly basic materials having high $pK_a$ values also function for this purpose.

Thus, polyamide or wool substrates treated with the non-sulfonated resole condensates of this invention in an aqueous treatment solution comprising the components described above exhibit excellent stain-resistance to acid dyes when the treatment bath pH is adjusted to a value in the range between pH 2 and pH 4 or to a value in the range between pH 6 and pH 8, preferably to a value in the range of pH 6 to pH 7. Note that the optimum pH of application may vary with different substrates or treatment bath compositions and should be determined experimentally for a given substrate, non-sulfonated resole, surfactant, and electrolyte using methods known to those skilled in the art.

EXAMPLE 1

A 400 ml shaker tube was charged with 75 g of 95% 4,4'-bis(hydroxyphenyl)sulfone (Diphone A), 4.5 g 4-hydroxy acetophenone (HAP), 23 g 37% formaldehyde solution, 26.7 g 30% NaOH and 180 g of water. The tube was sealed, swept with nitrogen and heated to 150° C. for 24 hours under autogenous pressure. The reaction was cooled to approximately 50° C. and 30 g 30% NaOH was added.

EXAMPLES 2–6

The procedure of EXAMPLE 1 was repeated, substituting for HAP the following phenolic compounds in the molar amounts indicated in Table 1: 4-hydroxybenzoic acid (4-HBA) in EXAMPLE 2, 3-hydroxybenzoic acid (3-HBA) in EXAMPLE 3, p-phenyl phenol (P3) in Example 4, bisphenol A (BPA) in EXAMPLE 5, and bisphenol AF (BPAF) in EXAMPLE 6.

EXAMPLE 7

Nylon, fibers (DuPont "ANTRON®" 1150, 3.75×3.75 twist), "SUPERBA®" heat set) were treated with 1.2% on the weight of the fiber (owf) resole condensate stain-resists of Examples 1 through 6 at a goods-to-liquor ratio of 1:32 at the pH values set forth in Table 1, at 65° C. for 10 minutes (except Example 4 which was treated at 80° C. for 20 minutes), in the presence or absence of 0.5–1.0% on the weight of the bath (owb) electrolytes such as sodium chloride or sodium sulfate. In some instances 0.1 to 5% owf of a commercial alkylated disulfonated diphenyl oxide surfactant ("Dowfax" 2A-4, Dow Chemical Co.) was added to the treatment bath. The treated fibers were then washed with water, air-dried and exposed at room temperature to a dye solution consisting of 0.2 g of and 3.2 g of citric acid in one liter of deionized water at a goods-to-liquor ratio of 1:40. After approximately 24 hours, the dye absorbed onto the fibers was determined at a wavelength of 498–502 nm by comparing the absorbance with that of an untreated control. A percent dye absorbed number of 90 means 90% of the dye was absorbed, indicating little stain-resistance to the dye. The lower the number, the better was the resistance to stain. The results of the evaluations are set forth in Table 1.

TABLE 1

| Example # | Phenolic Compound | Phenolic Compound/BHPS Mol. Ratio | Absorption % pH 2.5 | Absorption % pH 6.5 |
|---|---|---|---|---|
| untreated nylon | — | — | 100 | 100 |
| 1 | HAP | 0.1 | 0 | 1 |
| | | 0.3 | 2.2 | 0 |
| | | 0.5 | 0.3 | 0 |
| 2 | 4-HBA | 0.1 | 1.3 | 0 |
| | | 0.3 | 0.7 | 0 |
| | | 0.5 | 4.1 | 1.1 |
| 3 | 3-HBA | 0.1 | 2.1 | 0.6 |
| | | 0.3 | 0 | 0 |
| | | 0.5 | 0.3 | 0 |
| 4 | P3 | 0.1 | 2.7 | 0 |
| 5 | BPA | 0.1 | 0 | 0 |
| 6 | BPAF | 0.1 | 0 | 0 |

I claim:

1. A stain-resist composition comprising a resole condensate prepared by reacting a phenolic mixture comprising bis(hydroxy-phenyl)sulfone (BHPS) and at least one other phenolic compound with formaldehyde in the presence of a base comprising an inorganic compound having a pKa of 8.5 or higher, at a formaldehyde:phenolic mixture molar ratio in the range between 0.6:1.0 and 4.0:1.0, a base:phenolic mixture molar ratio in the range between 0.1:1.0 and 3.5:1.0, and a molar ratio of said at least one other phenolic compound:BHPS in the range between 0.05:1.0 and 1.0:1.0.

2. The composition of claim 1 wherein said base is selected from the group consisting of an alkali metal hydroxide, alkali metal carbonate, alkali metal bicarbonate, alkali metal borate, alkaline earth metal hydroxide, alkaline earth metal carbonate, alkaline earth metal borate and mixtures thereof.

3. The composition of claim 2 wherein said formaldehyde:phenolic mixture molar ratio is in the range between 0.6:1.0 and 1.1:1.0.

4. The composition of claim 2 wherein said base:phenolic mixture molar ratio is in the range between 0.2:1.0 and 1.0:1.0.

5. The composition of claim 2 wherein said molar ratio of said at least one other phenolic compound:BHPS is in the range between 0.1:1.0 and 0.5:1.0.

6. The composition of claim 1, wherein said bis (hydroxyphenyl)sulfone consists essentially of 4,4'-sulfonyldiphenol and said alkali metal hydroxide is sodium hydroxide.

7. A nylon or wool substrate having deposited on it an amount effective to impart resistance to staining by acid dyes of a stain-resist composition comprising a resole condensate prepared by reacting a phenolic mixture comprising bis (hydroxy-phenyl)sulfone and at least one other phenolic compound with formaldehyde in the presence of a base comprising an inorganic compound having a pKa of 8.5 or higher, at a formaldehyde:phenolic mixture molar ratio in the range between 0.6:1.0 and 4.0:1.0 and a base:phenolic mixture molar ratio in the range between 0.1:1.0 and 3.5:1.0, and a molar ratio of said at least one other phenolic compound:BHPS in the range between 0.05:1.0 and 1.0:1.0.

8. The substrate of claim 7 wherein said base is selected from the group consisting of an alkali metal hydroxide, alkali metal carbonate, alkali metal bicarbonate, alkali metal borate, alkaline earth metal hydroxide, alkaline earth metal carbonate, alkaline earth metal borate and mixtures thereof.

9. The substrate of claim 7, wherein said bis(hydroxy-phenyl)sulfone consists essentially of 4,4'-sulfonyldiphenol and said alkali metal hydroxide is sodium hydroxide.

10. A process for imparting acid dye stain-resistance to a nylon or wool substrate which comprises applying to said substrate an amount effective to impart resistance to staining by acid dyes of a stain-resist composition comprising a resole condensate prepared by reacting a phenolic mixture comprising bis(hydroxyphenyl)sulfone and at least one other phenolic compound with formaldehyde in the presence of a base comprising an inorganic compound having a pKa of 8.5 or higher, at a formaldehyde:phenolic mixture molar ratio in the range between 0.6:1.0 and 4.0:1.0 and a base:phenolic mixture molar ratio in the range between 0.1:1.0 and 3.5:1.0, and a molar ratio of said at least one other phenolic compound:BHPS in the range between 0.05:1.0 and 1.0:1.0.

11. The process of claim 10 wherein said base is selected from the group consisting of an alkali metal hydroxide, alkali metal carbonate, alkali metal bicarbonate, alkali metal borate, alkaline earth metal hydroxide, alkaline earth metal carbonate, alkaline earth metal borate and mixtures thereof.

12. The process of claim 11 wherein said bis(hydroxy-phenyl)sulfone consists essentially of 4,4'-sulfonyldiphenol and said alkali metal hydroxide is sodium hydroxide.

* * * * *